US007402959B2

(12) United States Patent
Chen et al.

(10) Patent No.: US 7,402,959 B2
(45) Date of Patent: Jul. 22, 2008

(54) PHASE SAMPLING PROTECTION DEVICE

(75) Inventors: Wei-Chang Chen, Kaohsiung (TW); Yi-Chao Chiang, Hsinchu (TW)

(73) Assignee: Logan Technology Corp., Hsinchu (TW)

( * ) Notice: Subject to any disclaimer, the term of this patent is extended or adjusted under 35 U.S.C. 154(b) by 242 days.

(21) Appl. No.: 11/331,088

(22) Filed: Jan. 13, 2006

(65) Prior Publication Data

US 2006/0279234 A1 Dec. 14, 2006

(30) Foreign Application Priority Data

Jun. 8, 2005 (TW) ..... 94209517 U

(51) Int. Cl.
*G05F 1/00* (2006.01)

(52) U.S. Cl. ..... 315/291; 315/194; 315/224; 315/307; 315/278

(58) Field of Classification Search ..... 315/194, 315/291, 224, 278, 307, 244, 209 R, DIG. 5, 315/DIG. 7; 363/56.05–56.11, 148, 153, 363/155

See application file for complete search history.

(56) References Cited

U.S. PATENT DOCUMENTS 6,008,593 A * 12/1999 Ribarich ..... 315/307
6,151,232 A * 11/2000 Furuhashi et al. ..... 363/97
6,259,615 B1 * 7/2001 Lin ..... 363/98
6,347,028 B1 * 2/2002 Hausman et al. ..... 361/93.1
6,534,930 B2 * 3/2003 Ito et al. ..... 315/291

* cited by examiner

*Primary Examiner*—Haissa Philogene

(57) ABSTRACT

A phase sampling protection device substantially includes a phase sampling circuit coupled between a tube circuit and a protection circuit. The phase sampling circuit captures a voltage signal and a current phase signal of the tube circuit for comparison, using phase comparing technique to detect an anomaly of the tube, if the tube doesn't function normally, then the phase sampling circuit driving the protection circuit to shut down the power supply of the tube to keep a transformer from burning down and other safety issues from happening.

9 Claims, 11 Drawing Sheets

PHASE SAMPLING PROTECTION DEVICE

BACKGROUND OF THE INVENTION

1. Field of the Invention

The present invention relates to a phase sampling protection device, and more particularly, to a phase sampling protection device using phase sampling technique to determine whether the tube functions normally to improve the accuracy in detection.

2. Description of the Prior Art

FIG. 1 illustrates a prior art tube circuit, which substantially comprises a tube circuit 91, a detection circuit 92 and a protection circuit 93, wherein detection circuit 92 comprises a RC rectifying circuit 921 and a comparator 922; detection circuit 92 coupling between the low-voltage end of transformer 911 of tube circuit 91 and protection circuit 93 to directly detect a low-voltage end signal of transformer 911 of tube circuit 91, RC rectifying circuit 921 rectifying the low-voltage end signal into a DC signal and outputting it to comparator 922, then comparator 922 comparing the DC signal with an reference signal to determine whether to drive protection circuit 93 or not, in order to drive protection circuit 93 to shut down the power supply of tube 912 to keep transformer 911 from burning down and other safety issues from happening.

However, in the above-mentioned detection method, the low-voltage end current of transformer 911 is current Io, which equals to the sum of current Ic1 (generated by high-voltage end capacitor C1), current Ic2 (generated by stray capacitor C2) and current Ic3 (generated by line coupling capacitor C3). The values of Ic1, Ic2, Ic3 will change as the voltage of tube 912 varies, so when tube 912 fails, the voltage of high-voltage end will increase due to no negative impedance effect from tube 912 to pull down the voltage, then Ic1 and Ic3 will also increase (Ic2=0 when tube is open circuit), therefore, the low-voltage end current Io will not drop significantly when tube 912 fails, making it difficult for comparator 922 of detection circuit 92 to determine whether tube 912 functions normally only by detecting the low-voltage end current signal, resulting in failure to drive protection circuit 93 and failure to keep transformer 911 of tube circuit 91 from burn down or other safety issues from happening.

Therefore, the above-mentioned prior art detection method presents several shortcomings to be overcome.

In view of the above-described deficiencies of prior-art tube circuit, after years of constant effort in research, the inventor of this invention has consequently developed and proposed a phase sampling protection device in the present invention.

SUMMARY OF THE INVENTION

The present invention is to provide a phase sampling circuit to capture a voltage phase signal and a current phase signal of the tube circuit for comparison, to accurately determine whether the tube functions normally, and then to drive the protection circuit to shut down the power supply of the tube in case of an anomaly to keep the transformer of the tube circuit from burning down or other safety issues from happening.

The present invention provides a phase sampling protection device, which comprises a tube circuit, a phase sampling circuit and a protection circuit, wherein the phase sampling circuit having an input for capturing a voltage phase signal and a current phase signal of tube circuit, and an output coupled with the protection circuit, therefore the phase sampling circuit coupling between the tube circuit and the protection circuit; the phase sampling circuit using phase comparing technique to compare the voltage phase signal and the current phase signal to accurately determine whether the tube functions normally, if the tube doesn't function normally, then the phase sampling circuit driving the protection circuit to shut down the power supply of the tube to keep the transformer from burning down.

BRIEF DESCRIPTION OF THE DRAWINGS

The drawings disclose illustrative embodiments of the present invention which serve to exemplify the various advantages and objects hereof, and are as follows.

DETAILED DESCRIPTION OF THE PREFERRED EMBODIMENT

Figure 1:
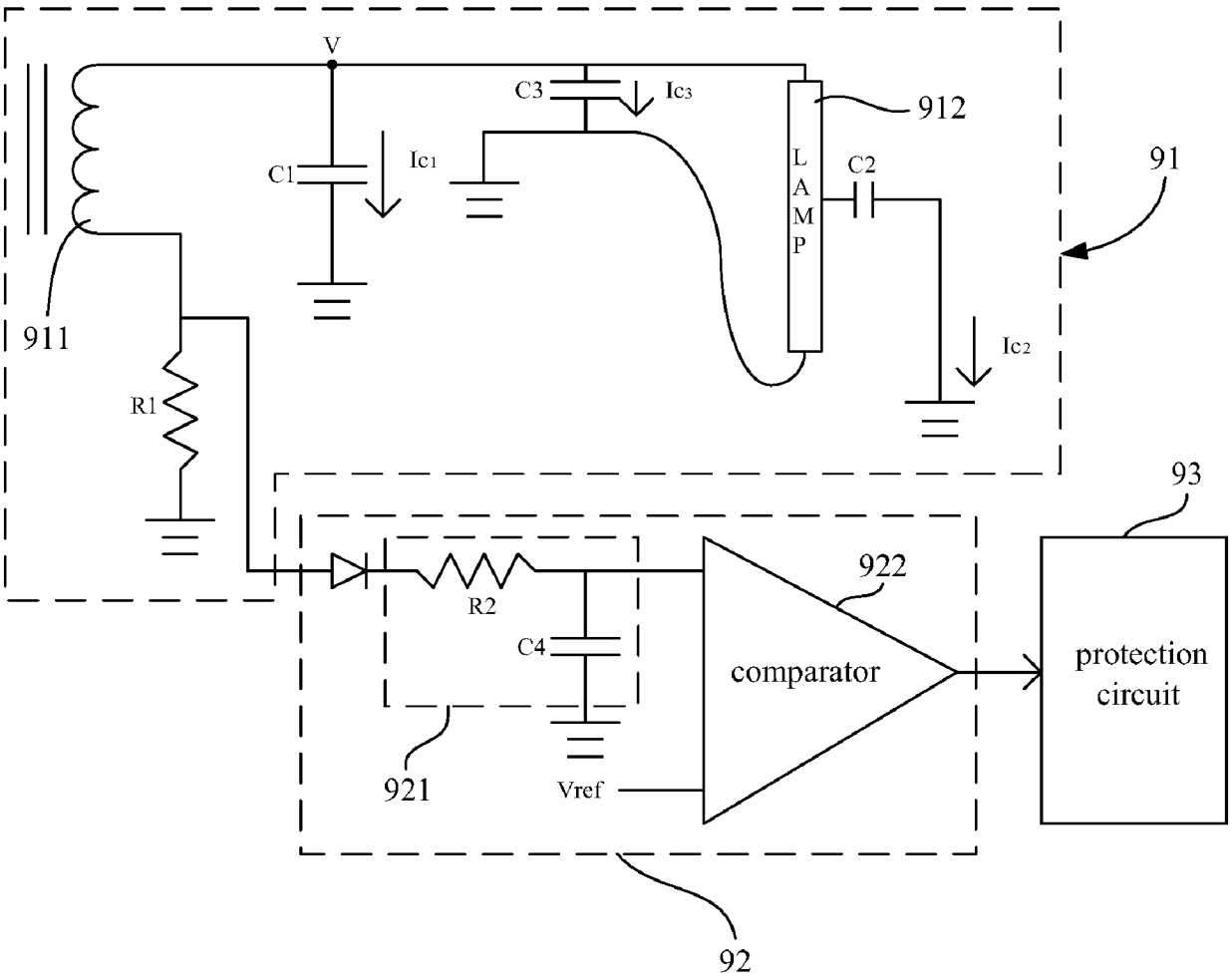
PRIOR ART FIG.1
FIG. 1 illustrates a schematic diagram of a prior art tube circuit.
Figure 2:
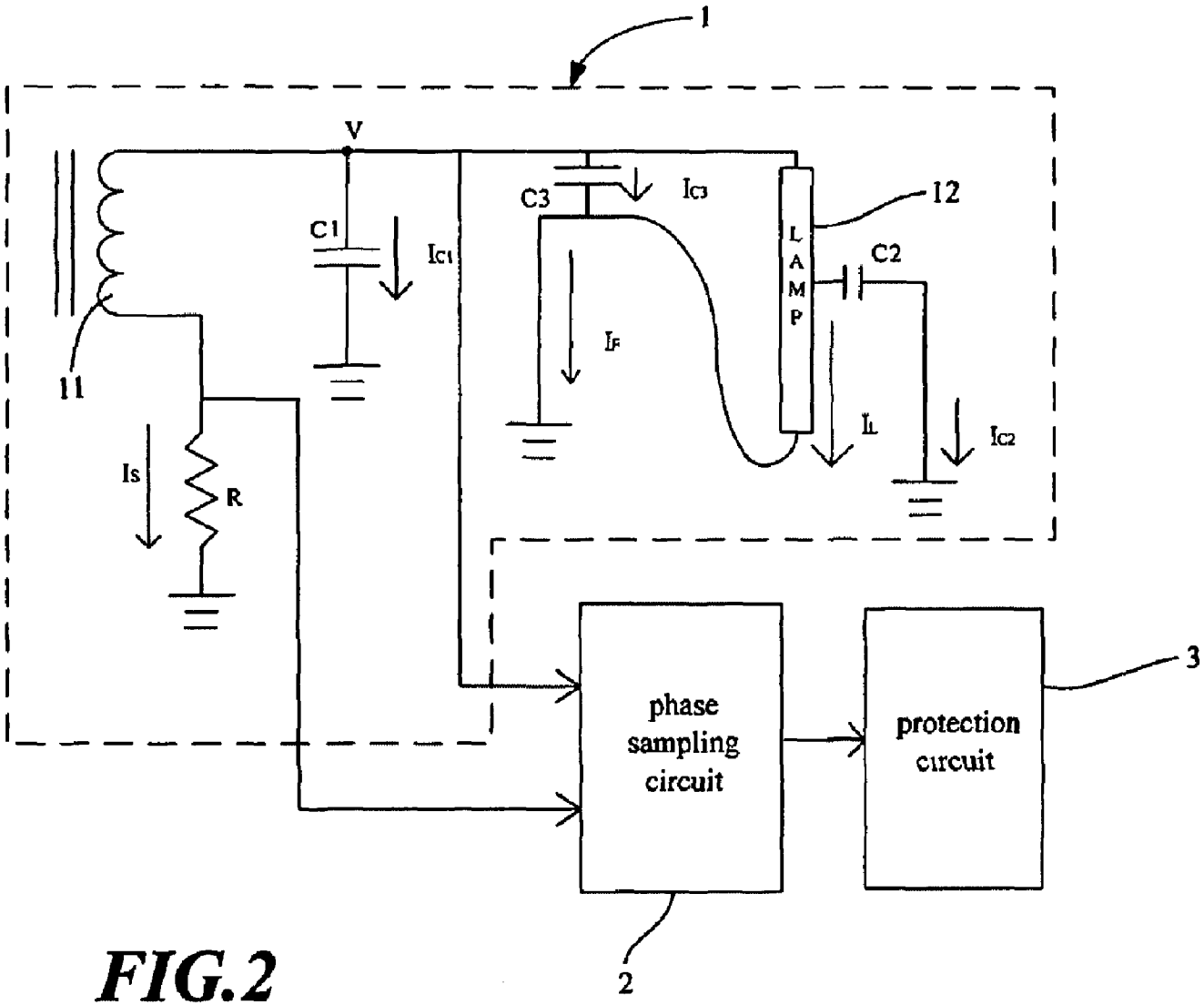
FIG. 2 illustrates a schematic diagram of a first embodiment of the phase sampling protection device of the present invention.

FIG. 2 illustrates a schematic diagram of a first embodiment of the phase sampling protection device of the present invention. The phase sampling protection device comprises a tube circuit 1, a phase sampling circuit 2 and a protection circuit 3; wherein an input of phase sampling circuit 2 couples with voltage V of high-voltage end of transformer 11 and current Is of low-voltage end of transformer 11, and an output of phase sampling circuit 2 couples with protection circuit 3 to let phase sampling circuit 2 placed between tube circuit 1 and protection circuit 3; tube circuit 1 comprises transformer 11, resistor R1 R2, capacitor C1, C2, C3 and tube 12; wherein current Is flows through resistor R, Ic1 flows through high-voltage-end-to-ground capacitor C1 of secondary side of transformer 11, Ic2 flows through stray capacitor C2 of LCD panel, Ic3 flows through line-coupling capacitor C3, IL flows through tube 12, and IF is the feedback current of tube 12. For Is=−(Ic1+Ic2+Ic3+IL), when tube 12 is opne circuit, IL=0, Ic2=0, so Is=−(Ic1+Ic3); wherein Ic1=jW(C1)V, IC3=jW(C3)V, so Is=−(Ic1+Ic3)=−jW(C1+C3)V, as described above, the phase of (Ic1+Ic3) leads the phase of voltage V by 90 degrees, and the phase of Is lags behind that of V by 90 degrees. For Is lagging behind V by 90 degree, when measuring the phase of voltage V at positive half period or negative half period, the phase of current Is is exactly contained within the half of the positive half period and the half of negative half period, so the sampled area of current Is in positive half period is approximately the same as that of in negative half period. Therefore, when voltage V is at positive half period or negative half period, using the DC-level signal of current Is flowing through RC circuit to be the detection signal of protection circuit 3 will eliminate the effect of high-voltage-end-to ground capacitor C1 and line-coupling capacitor C2 to clearly differentiate whether tube 12 is under normal operation or open circuit condition. Hence, by using phase sampling circuit 2 to capture the phase of voltage V and current Is, it is viable to accurately determine whether tube 12 functions normally, if it doesn't, then phase sampling circuit 2 will drive protection circuit 3 to shut down the power supply of tube circuit 1 to keep transformer 11 from burning down.

Figure 3:
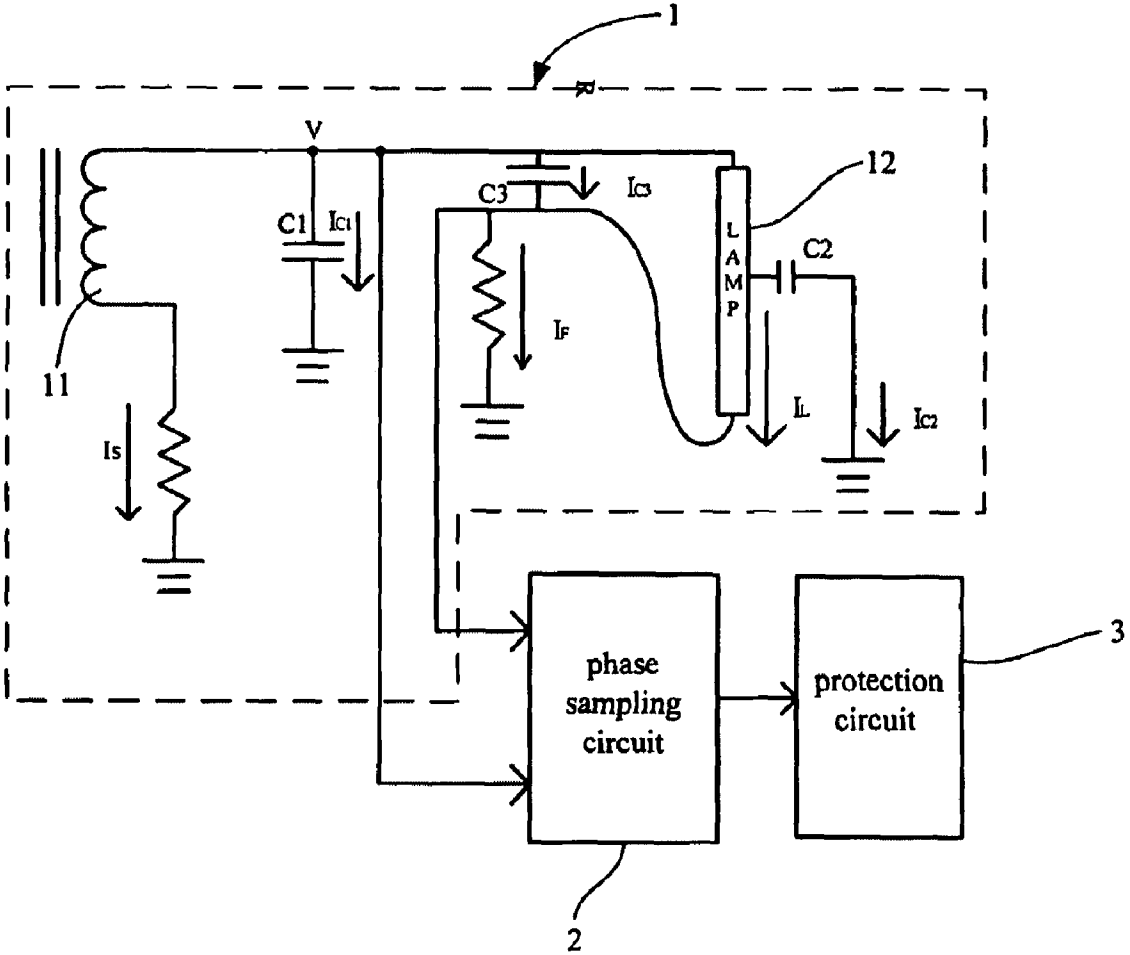
FIG. 3 illustrates a schematic diagram of a second embodiment of the phase sampling protection device of the present invention.

FIG. 3 illustrates a second embodiment of the present invention, wherein the principle of operation is the same as that of FIG. 2. An input of phase sampling circuit 2 couples with voltage V of high-voltage end of secondary side of transformer 11 and tube feedback current IF; wherein tube feedback current IF=IL+Ic3. When tube 12 is open circuit, IL=0, meanwhile, measuring the phase of voltage V at positive half period or negative half period will find the sampled area of IC3 at positive half period is the same as the sampled area of IC3 at negative half period; therefore, using the DC-level signal of feedback current IF flowing through RC circuit to be the detection signal of protection circuit 3 will also eliminate the effect of line-coupling capacitor C3 to clearly differentiate whether tube 12 is under normal operation or open circuit condition.

Figure 4:
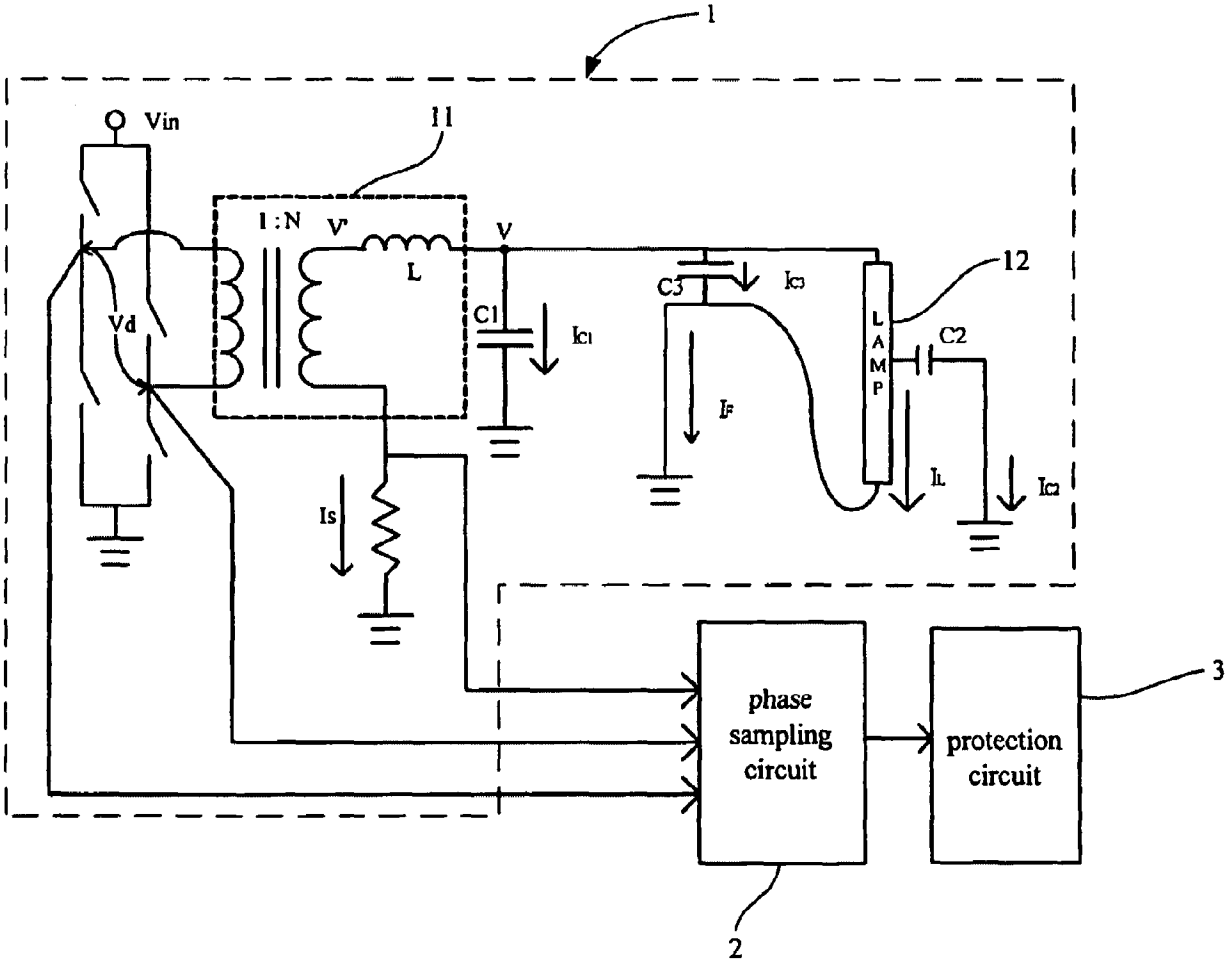
FIG. 4 illustrates a schematic diagram of a third embodiment of the phase sampling protection device of the present invention.
Figure 4A:
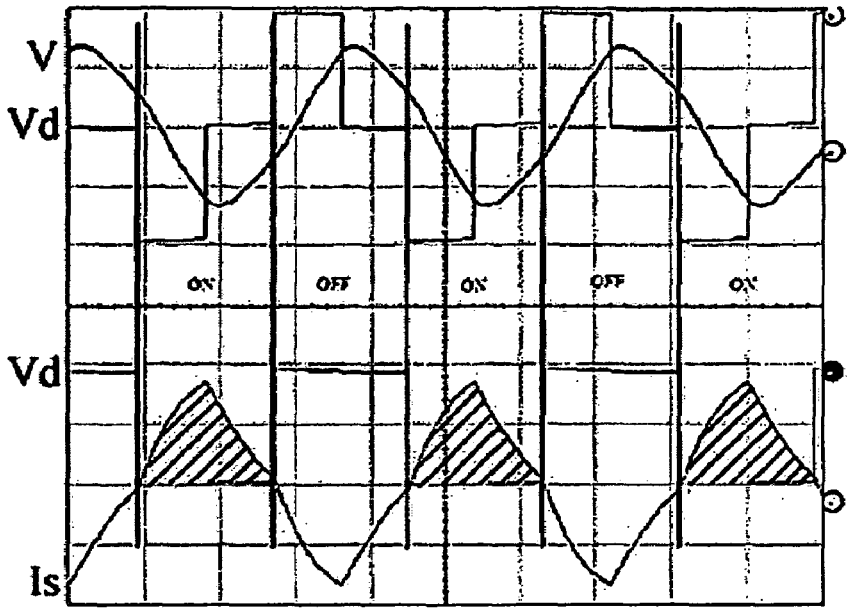
FIG. 4A is an oscillogram of the tube in FIG. 4 when the tube is under normal operation.
Figure 4B:
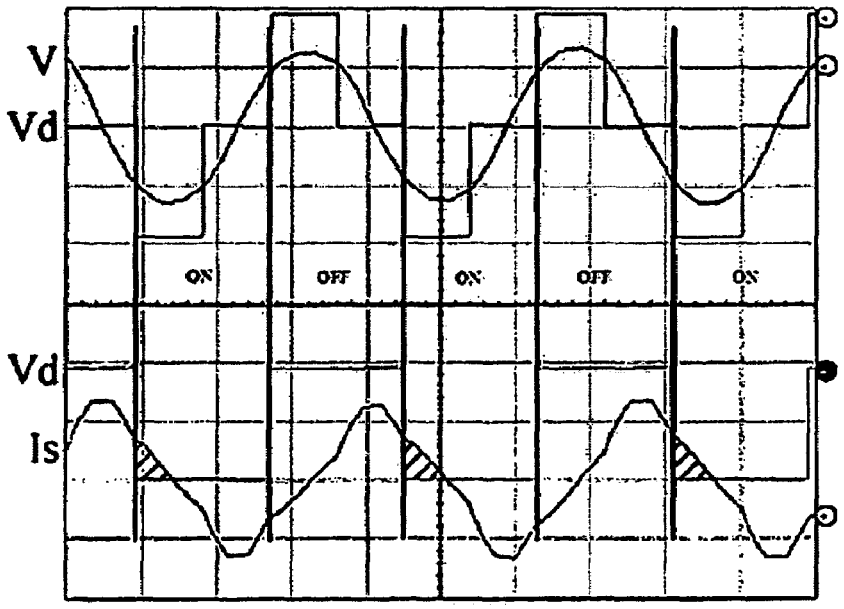
FIG. 4B is an oscillogram of the tube in FIG. 4 when the tube is open circuit.

FIGS. 4, 4A and 4B illustrate a third embodiment of the phase sampling protection device of the present invention, wherein transformer 11 is to be analyzed according to leakage inductance and turn ratio respectively. An input of phase sampling circuit 2 couples with input voltage Vd of the primary side of transformer 11 and low-voltage end current Is of the secondary side of transformer 11, for Is=−(IC1+IC2+IC3+IL), when tube 12 is open circuit, IL=0, IC2=0, so Is=−(IC1+IC3), wherein IC1=jW(C1)V, IC3=jW(C3)V, so Is=−(IC1+IC3)=−jW(C1+C3)V, it can be concluded that the phase of IC1 leads the phase of V by 90 degrees, and the phase of Is lags behind that of V by 90 degrees. When tube 12 is open circuit, V={1/[jW(C1+C3)]}/{jWL+1/[jW(C1+C3)]}*V'=V'/[1−W2L(C1+C3)], wherein V'=*Vd, so V=NVd/[1−W2L(C1+C3)], from this, when [1−W2L(C1+C3)]>0, V is in phase with Vd, and when [1−W2L(C1+C3)]<0, V is in inverse phase with Vd. Therefore, when tube 12 is open circuit, output voltage V is in phase with Vd, so low-voltage end current Is of the secondary side of transformer 11 lags behind both output voltage V and input voltage Vd by 90 degrees, that means at least half of the positive half period of current Is is contained within the later half of the positive half period of input voltage Vd (as shown in FIG. 4A, 4B). Hence, measuring the DC-level signal of current Is (flowing through RC circuit) contained within the first half of the negative half period of voltage Vd, it is viable to eliminate the effect of high-voltage-end-to ground capacitor C1 and stray capacitor C2 when tube 12 is open circuit, and to clearly differentiate the sampled areas of Is when tube 12 is in normal operation/open circuit condition to accurately activate the protection circuit. Similarly, when output voltage V is in inverse phase with input voltage Vd, the principle of operation is the same, though Vd is in inverse phase.

Figure 5:
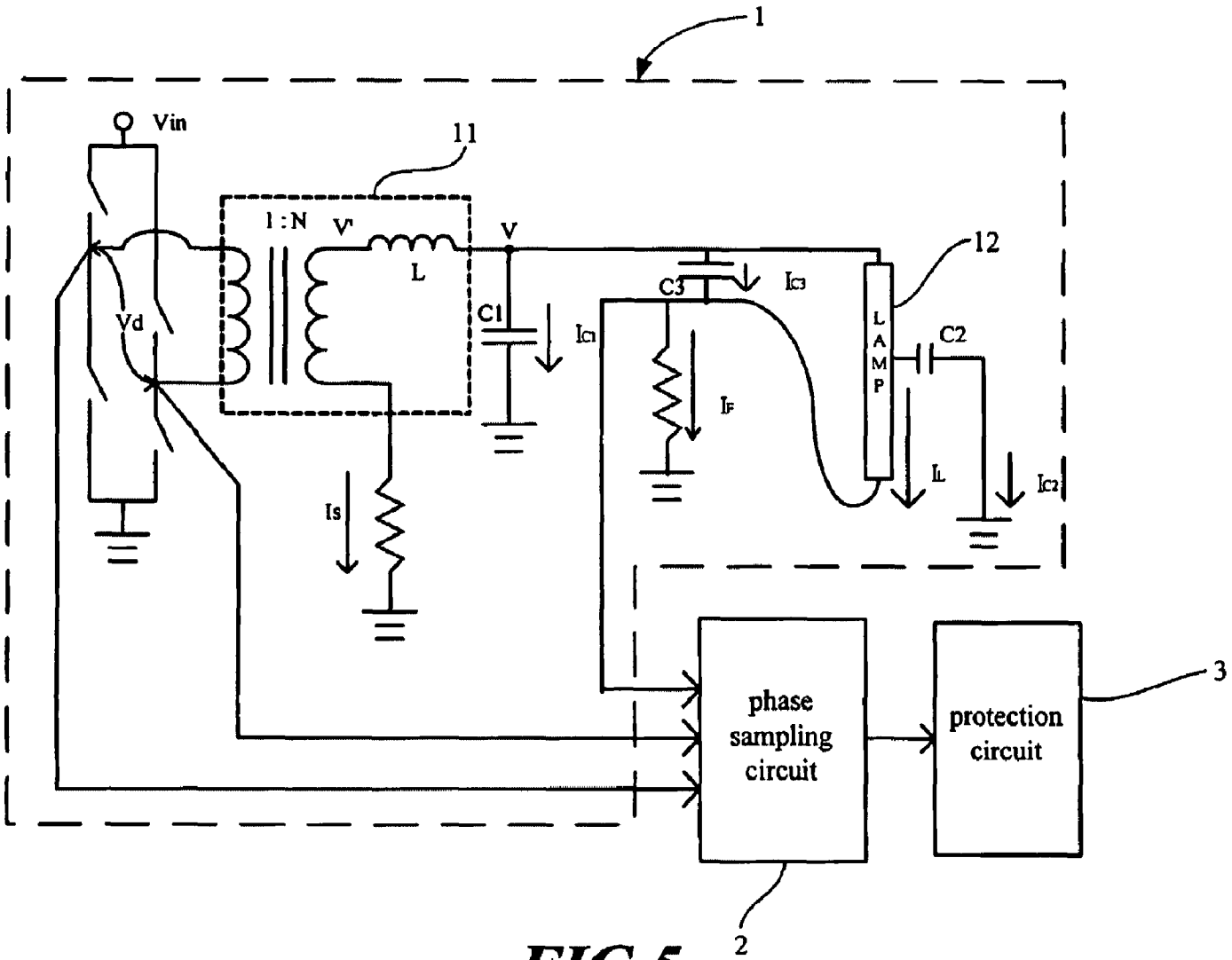
FIG. 5 illustrates a schematic diagram of a fourth embodiment of the phase sampling protection device of the present invention.
Figure 5A:
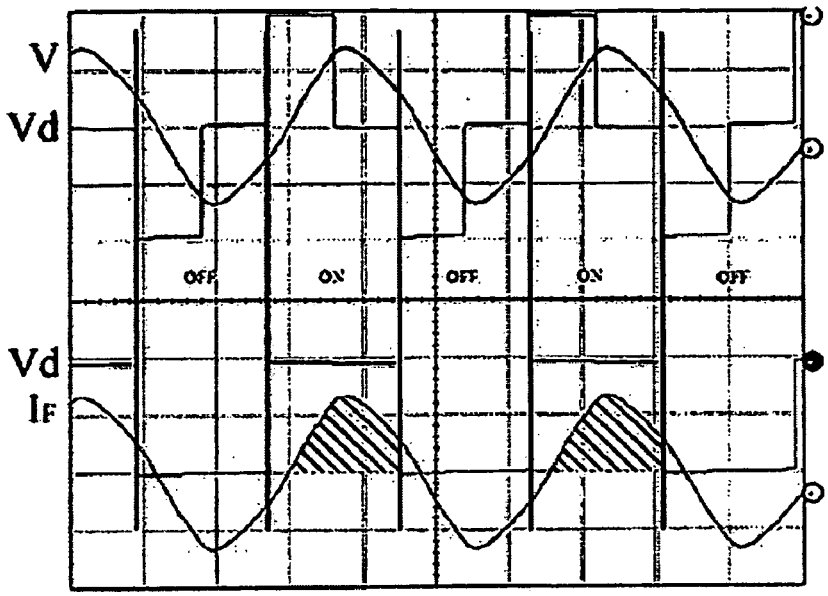
FIG. 5A is an oscillogram of the tube in FIG. 5 when the tube is under normal operation.
Figure 5B:
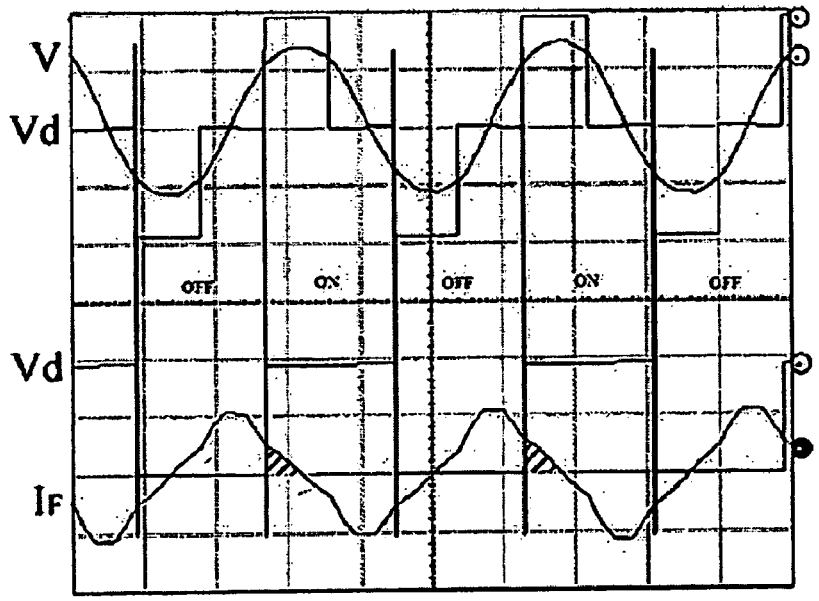
FIG. 5B is an oscillogram of the tube in FIG. 5 when the tube is open circuit.

FIGS. 5, 5A and 5B illustrate a fourth embodiment of the phase sampling protection device of the present invention, the principle of operation is the same as that of FIG. 4. An input of phase sampling circuit 2 couples with input voltage Vd of the primary side of transformer 11 and feedback current IF of the secondary side of transformer 11. For IF=IL+IC3, when tube 12 is open circuit, IL=0, and IC3=jW(C3)V, so the phase of IC3 leads the phase of output voltage V by 90 degrees, that means at least half the area of the positive half period of IC3 is contained within the first half of the positive half period of input voltage Vd (as shown in FIG. 5A, 5B). Hence, measuring the DC-level signal of current Is (flowing through RC circuit) contained within the first half of the positive half period of voltage Vd to be the detection signal of protection circuit 3, it is viable to eliminate the effect of line-coupling stray capacitor C2 when tube 12 is open circuit, and to clearly differentiate the sampled areas of IF when tube 12 is in normal operation/open circuit condition to accurately activate the protection circuit.

Figure 6:
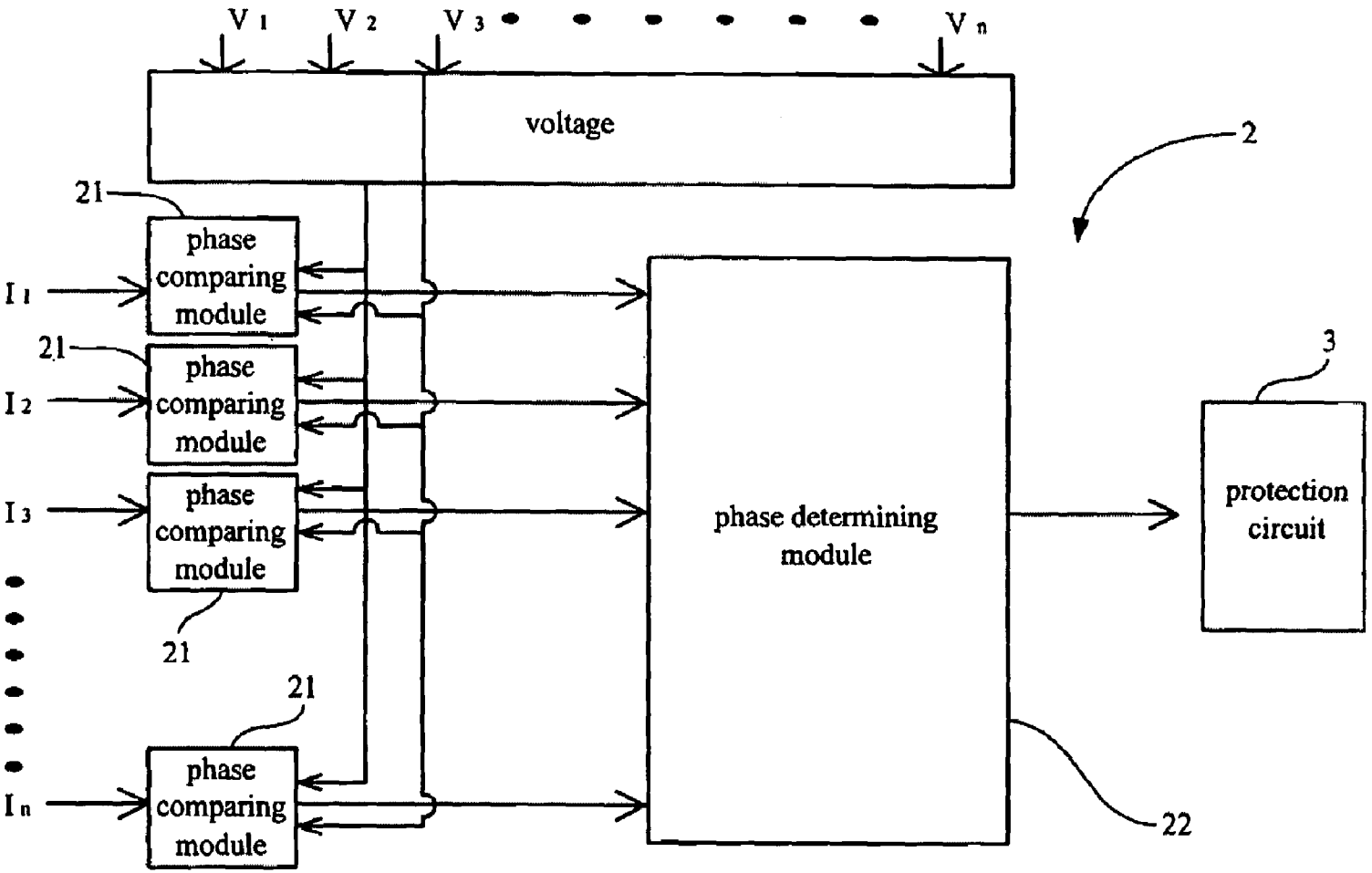
FIG. 6 illustrates a schematic diagram of a first embodiment of the phase sampling circuit of the phase sampling protection device in the present invention.

FIG. 6 illustrates a first embodiment of the phase sampling circuit in the present invention. Phase sampling circuit comprises a phase determining module 22 and at least one phase comparing module 21. As shown in FIG. 6, each phase comparing module simultaneously receiving a first voltage signal of the positive half period and a second voltage signal of the negative half period, while receiving a current signal of a different detection point respectively, each phase comparing module comparing the phases of received voltage signals and the phase of received current signal to generate a result signal, then phase determining module 22 receiving the result signal to determine whether tube 12 functions normally, if tube 12 doesn't function normally, then phase determining module 22 will activate protection circuit 3.

Figure 7:
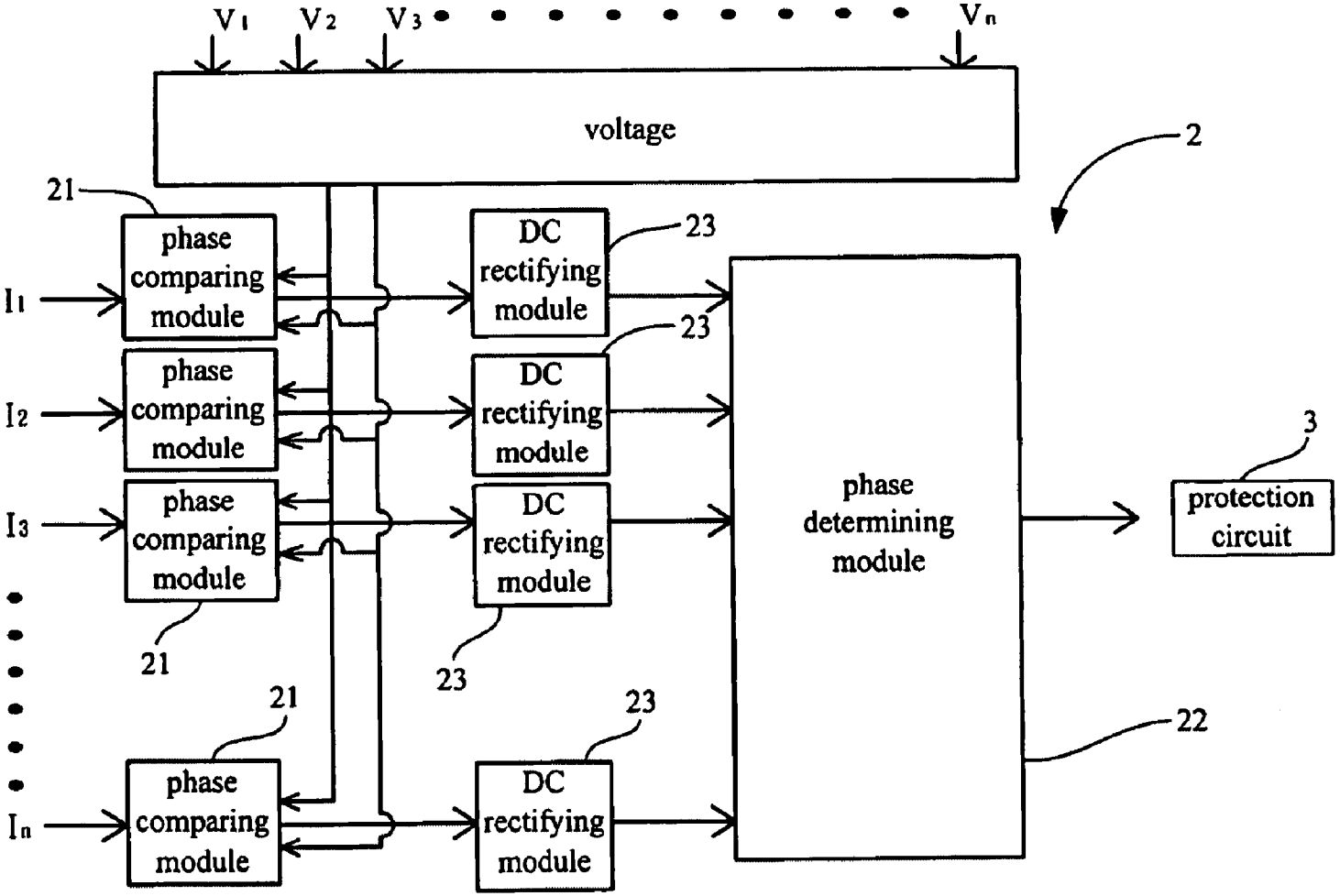
FIG. 7 illustrates a schematic diagram of a second embodiment of the phase sampling circuit of the phase sampling protection device in the present invention.

Please refer to FIG. 7, which illustrates a second embodiment of the phase sampling circuit in the present invention. While the principle of operation and the structure is mostly the same as those of FIG. 6, it is different in that a DC rectifying module 23 is placed between phase comparing module 21 and phase determining module 22. DC rectifying module receives the signal from phase comparing module 21 and rectifies it into a DC-level signal, then outputs the DC-level signal to phase determining module 22 for determining whether tube 12 functions normally.

Figure 8:
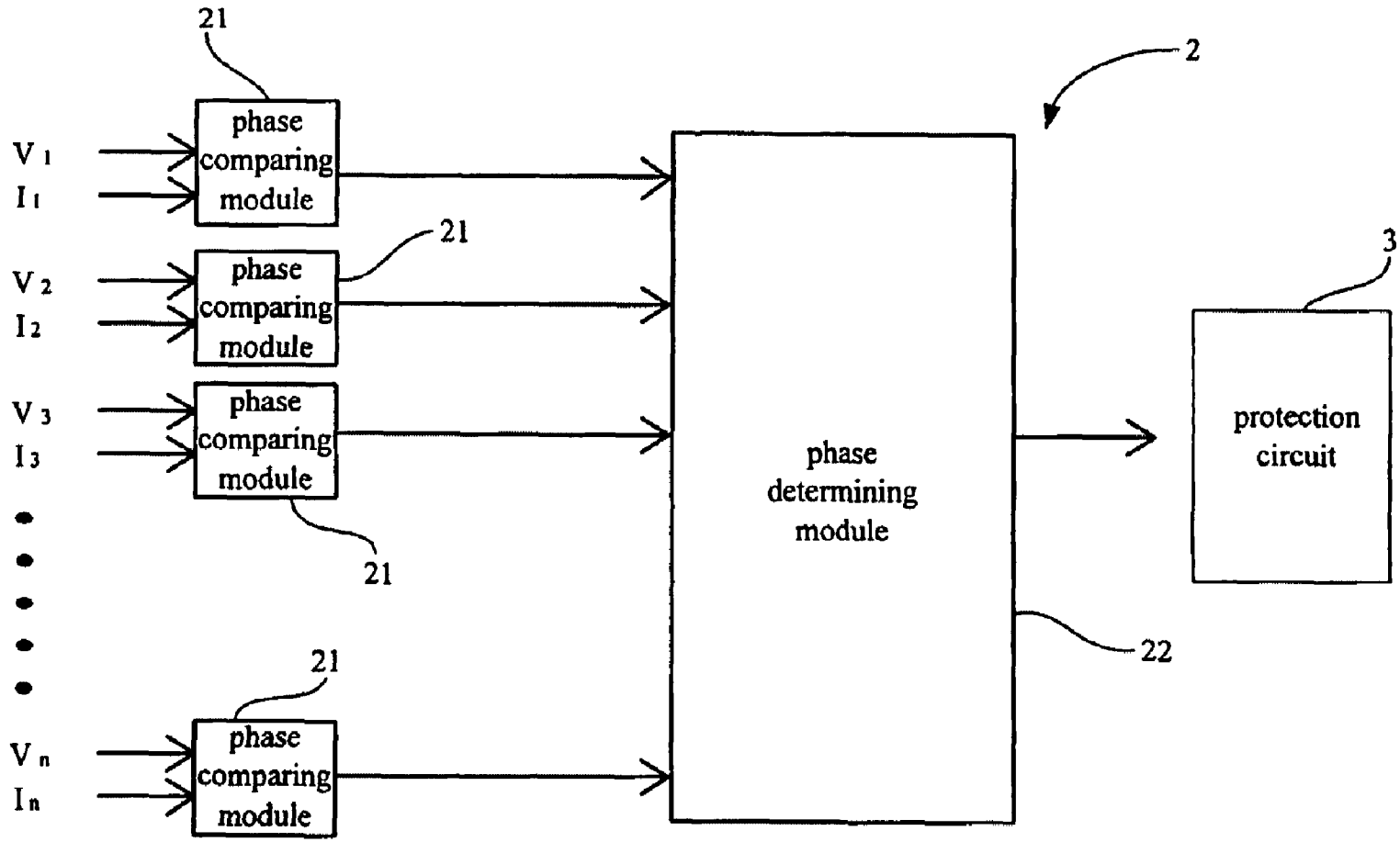
FIG. 8 illustrates a schematic diagram of a third embodiment of the phase sampling circuit of the phase sampling protection device in the present invention.

Please refer to FIG. 8, which illustrates a third embodiment of the phase sampling circuit in the present invention. While the structure of FIG. 8 is the same as that of FIG. 6, it is slightly different in the principle of operation, wherein each phase comparing module 21 receives a different voltage phase signal and a different current phase signal respectively, then phase comparing module 21 compares the received the voltage phase signal and the received current phase signal respectively to generate a result signal, phase determining module 22 receives the result signal for determining whether tube 12 functions normally.

Figure 9:
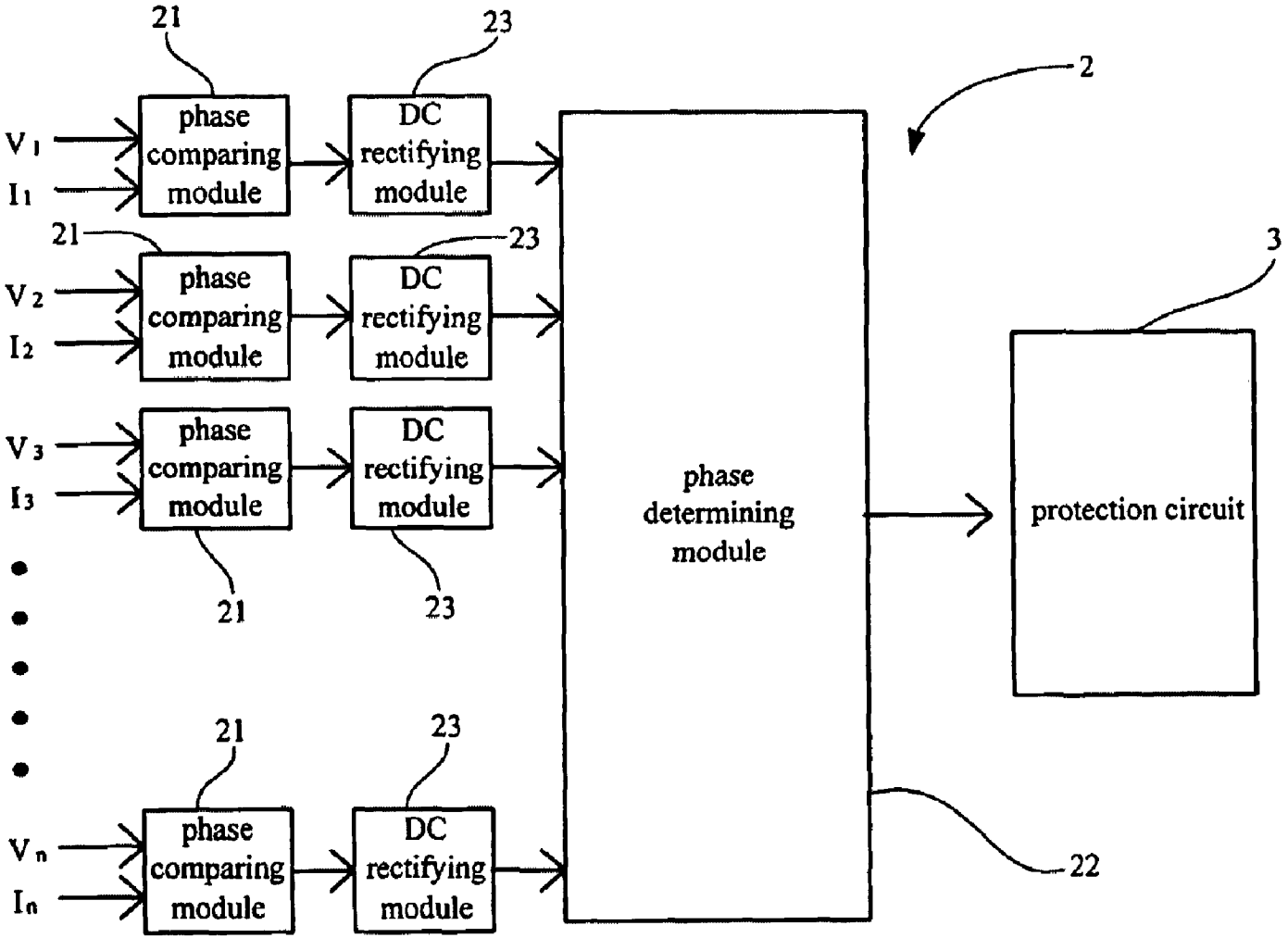
FIG. 9 illustrates a schematic diagram of a fourth embodiment of the phase sampling circuit of the phase sampling protection device in the present invention.

Please refer to FIG. 9, which illustrates a fourth embodiment of the phase sampling circuit in the present invention. While the structure of FIG. 9 is the same as that of FIG. 7, it is slightly different in the principle of operation, wherein each phase comparing module 21 receives a different voltage phase signal and a different current phase signal respectively, then each phase comparing module 21 compares the received the voltage phase signal and the received current phase signal respectively to generate a result signal. DC rectifying module receives the result and rectifies it into a DC-level signal, then outputs the DC-level signal to phase determining module 22 for determining whether tube 12 functions normally.

The present invention provides a phase sampling protection device, which compared with other prior art temperature detection devices, is advantageous in:

The present invention provides a phase sampling circuit to capture a voltage phase signal and a current phase signal of the tube circuit for comparison, to accurately determine whether the tube functions normally, and then to drive the protection circuit to shut down the power supply of the tube in case of an anomaly to keep the transformer of the tube circuit from burning down or other safety issues from happening.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A phase sampling protection device comprising:

a tube circuit including a transformer, a resistor, a capacitor and a tube;

a protection circuit for shutting down a power supply of the tube circuit; and a phase sampling circuit having an input for capturing a voltage phase signal and a current phase signal of the tube circuit and an output coupled with the protection circuit, the phase sampling circuit comparing the voltage phase signal and the current phase signal of the tube circuit to accurately determine whether the tube functions normally, if the tube doesn't function normally, then the phase sampling circuit driving the protection circuit to shut down the power supply of the tube to keep the transformer from burning down.

2. The phase sampling protection device of claim 1, wherein the input of the phase sampling circuit couples with an output voltage of a secondary side of the transformer and a current of a low-voltage end of the secondary side of the transformer to capture a voltage phase signal and a current phase signal of the secondary side of the transformer for comparison.

3. The phase sampling protection device of claim 1, wherein the input of the phase sampling circuit couples with an output voltage of a secondary side of the transformer and a feedback current of the tube to capture a voltage phase signal and a current phase signal of the secondary side of the transformer for comparison.

4. The phase sampling protection device of claim 1, wherein the input of the phase sampling circuit couples with an input voltage of a primary side of the transformer and a current of a low-voltage end of the secondary side of the transformer to capture a voltage phase signal of the primary side of the transformer and a current phase signal of the secondary side of the transformer for comparison.

5. The phase sampling protection device of claim 1, wherein the input of the phase sampling circuit couples with an input voltage of a primary side of the transformer and a feedback current of the tube to capture a voltage phase signal of the primary side of the transformer and a current phase signal of the secondary side of the transformer for comparison.

6. The phase sampling protection device of claim 1, wherein the phase sampling circuit comprises at least one phase comparing module and a phase determining module, an output of each phase comparing module coupling with an input of the phase determining module, an output of the phase determining module coupling with the protection circuit; wherein each phase comparing module simultaneously receiving a same voltage phase signal, while receiving a same or a different current phase signal respectively, each phase comparing module comparing the received voltage phase signal and the received current phase signal to generate a result signal, the phase determining module receiving the result signal to determine whether the tube functions normally, if the tube doesn't function normally, then the phase determining module driving the protection circuit to shut down the power supply of the tube.

7. The phase sampling protection device of claim 1, wherein the phase sampling circuit comprises at least one phase comparing module and a phase determining module, an output of each phase comparing module coupling with an input of the phase determining module, an output of the phase determining module coupling with the protection circuit; wherein each phase comparing module receiving one voltage phase signal and one current phase signal respectively, each phase comparing module comparing the received voltage phase signal and the received current phase signal to generate a result signal, the phase determining module receiving the result signal to determine whether the tube functions normally, if the tube doesn't function normally, then the phase determining module driving the protection circuit to shut down the power supply of the tube.

8. The phase sampling protection device of claim 1, wherein the phase sampling circuit comprises at least one phase comparing module and DC rectifying module, and a phase determining module, an output of each phase comparing module coupling with an input of each DC rectifying module, an output of each the DC rectifying module coupling with phase determining module, and an output of the phase determining module coupling with the protection circuit; wherein each phase comparing module simultaneously receiving a same voltage phase signal, while receiving a same or a different current phase signal respectively, each phase comparing module comparing the received voltage phase signal and the received current phase signal to generate a result signal, the DC rectifying module receiving the result signal for outputting a DC-level result signal, the phase determining module receiving the DC-level result signal to determine whether the tube functions normally, if the tube doesn't function normally, then the phase determining module driving the protection circuit to shut down the power supply of the tube.

9. The phase sampling protection device of claim 1, wherein the phase sampling circuit comprises at least one phase comparing module and DC rectifying module, and a phase determining module, an output of each phase comparing module coupling with an input of each DC rectifying module, an output of each the DC rectifying module coupling with phase determining module, and an output of the phase determining module coupling with the protection circuit; wherein each phase comparing module receiving one voltage phase signal and one current phase signal respectively, each phase comparing module comparing the received voltage phase signal and the received current phase signal to generate a result signal, the DC rectifying module receiving the result signal for outputting a DC-level result signal, the phase determining module receiving the DC-level result signal to determine whether the tube functions normally, if the tube doesn't function normally, then the phase determining module driving the protection circuit to shut down the power supply of the tube.

* * * * *

UNITED STATES PATENT AND TRADEMARK OFFICE

CERTIFICATE OF CORRECTION

PATENT NO. : 7,402,959 B2
APPLICATION NO. : 11/331088
DATED : July 22, 2008
INVENTOR(S) : Wei-Chang Chen It is certified that error appears in the above-identified patent and that said Letters Patent is hereby corrected as shown below:

Title page, item [73]: assignee should be --Logah Technology Corp.-- instead of "Logan Technology Corp.".

Signed and Sealed this

Twenty-fifth Day of November, 2008

JON W. DUDAS
*Director of the United States Patent and Trademark Office*